US011800267B2

(12) United States Patent
Xiao et al.

(10) Patent No.: US 11,800,267 B2
(45) Date of Patent: Oct. 24, 2023

(54) SPEAKER BOX

(71) Applicant: AAC Microtech (Changzhou) Co., Ltd., Changzhou City (CN)

(72) Inventors: Bo Xiao, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 30 days.

(21) Appl. No.: 17/566,728

(22) Filed: Dec. 31, 2021

(65) Prior Publication Data

US 2023/0156383 A1 May 18, 2023

(30) Foreign Application Priority Data

Nov. 17, 2021 (CN) ..... 202111359093.3

(51) Int. Cl.
*H04R 9/04* (2006.01)
*H04R 1/02* (2006.01)
*H04R 9/02* (2006.01)

(52) U.S. Cl.
CPC ..... *H04R 1/021* (2013.01); *H04R 9/027* (2013.01); *H04R 9/045* (2013.01); *H04R 2400/11* (2013.01)

(58) Field of Classification Search
CPC ... H04R 9/00; H04R 9/04; H04R 9/041; H04R 9/045; H04R 9/046; H04R 9/06
See application file for complete search history.

(56) References Cited

U.S. PATENT DOCUMENTS

| | | | | |
|---|---|---|---|---|
| 5,432,758 | A * | 7/1995 | Sone | H04R 9/00 367/175 |
| 2002/0008602 | A1* | 1/2002 | Kyouno et al. | G10K 9/20 335/220 |
| 2013/0083957 | A1* | 4/2013 | Soininen et al. | H04R 1/023 381/391 |
| 2018/0124503 | A1* | 5/2018 | Hui | H04R 9/025 |

* cited by examiner

*Primary Examiner* — Suhan Ni
(74) *Attorney, Agent, or Firm* — W&G Law Group

(57) ABSTRACT

Provided is a speaker box, including a speaker, comprises a frame, a first vibration system and a magnetic circuit system fixed on the frame; the first vibration system providing a diaphragm vibrate along a first direction; a housing with an accommodation space, includes: a bottom wall facing the diaphragm, and a sidewall bending and extending from an outer edge of the bottom wall; wherein the speaker received in the accommodation space, and the frame of the speaker comprises a split body of a first frame and a second frame, the second frame extends and fixed to the sidewall.

9 Claims, 9 Drawing Sheets

SPEAKER BOX

TECHNICAL FIELD

The present disclosure relates to the field of electro-acoustic conversion, in particular to a speaker for an electronic audio product.

BACKGROUND

In the related art, the speaker in the housing of the speaker box is vulnerable when the falling impact acts to the speaker, and the speaker is tend to be breaking.

Therefore, it needs to provide a speaker box to solve the above technical problem.

SUMMARY

An objective of the present disclosure is to provide a speaker with desirable sealing performance.

An embodiment of the present disclosure provides A speaker box, comprising: a speaker, comprises a frame, a first vibration system and a magnetic circuit system fixed on the frame; the first vibration system providing a diaphragm vibrate along a first direction; a housing with an accommodation space, comprises: a bottom wall facing the diaphragm, and a sidewall bending and extending from an outer edge of the bottom wall; wherein the speaker received in the accommodation space, and the frame of the speaker comprises a split body of a first frame and a second frame, the second frame extends and fixed to the sidewall.

Further, wherein both ends of the first frame are bent inward to form a first connecting part, the second frame is connected to the first connecting part.

Further, wherein the first connecting part and the second frame are connected by welding.

Further, wherein a limiting portion formed on a side facing the frame of the diaphragm, the limiting portion is connected to the first connecting part.

Further, wherein the diaphragm and the frame are integrally formed as a whole.

Further, wherein an avoiding groove is recessed on the second frame along the first direction, and the speaker is connected to the housing through the avoiding groove.

Further, wherein the magnetic circuit system is welded to the avoiding groove.

Further, wherein the first vibration system further comprises: a first coil driving the diaphragm to vibrate along the first direction; a skeleton connecting the first coil and the diaphragm, and an elastic diaphragm assembly elastically supporting the skeleton, the skeleton comprises an skeleton body portion, a first spacer extending from an inner side of the skeleton body portion towards the first coil along the first direction, and a second spacer extending from an outer side of the skeleton body portion towards the elastic diaphragm assembly along the first direction; the elastic diaphragm assembly comprises an elastic diaphragm assembly fixing portion fixed to the frame and an elastic diaphragm assembly vibration portion fixed to the first spacer.

Further, wherein further comprises a second vibration system vibrate along a second direction perpendicular to the first direction; the second vibration system comprises a spacing diaphragm, a counterweight, an elastic member and a second coil fixed to the counterweight, the spacing diaphragm comprises a spacing diaphragm fixed portion and a spacing diaphragm vibrating portion formed by bending along the a side of the spacing diaphragm fixing portion; the spacing diaphragm fixing portion is connected to the housing while the spacing diaphragm vibrating portion is connected to the counterweight, and an end of the elastic member is connected to the counterweight while the other end is connected to the housing, the second coil is spaced from the magnetic circuit system along the first direction.

Further, wherein the elastic member comprises a second connecting portion and a third connecting portion, an undulating bending structure is providing at an angle between the second connecting portion and the third connecting portion.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

Figure 1:
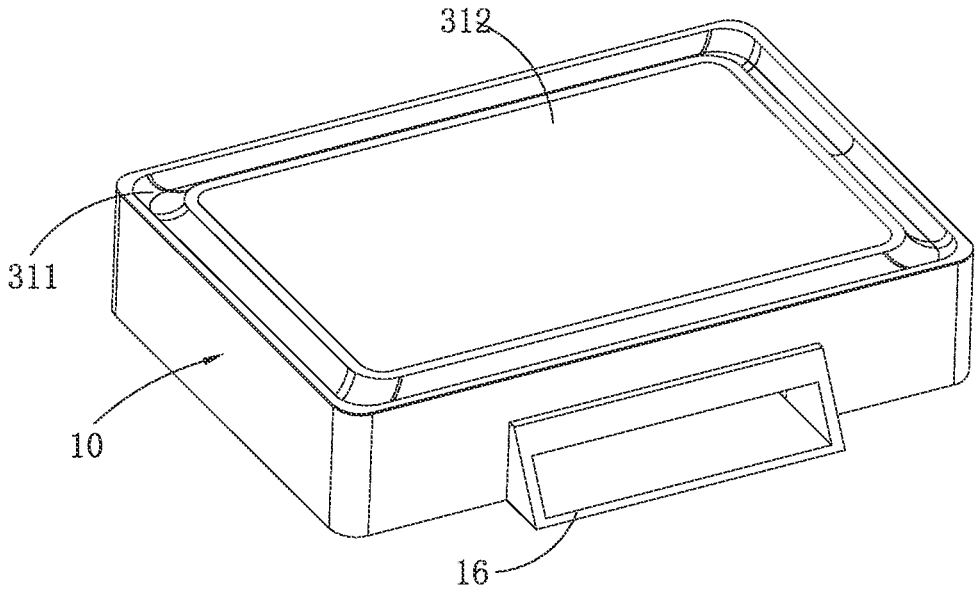
FIG. 1 is a three-dimensional view illustrating a structure of a speaker box according to an embodiment of the present disclosure.

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

In FIGS. 1-5, the speaker box includes a housing 10 with accommodation space, and a speaker 20, received in the housing 10. The speaker includes frame 21, a first vibration system 22 and magnetic circuit system 23. The first vibration system 22 and magnetic circuit system 23 are fixed on the frame 21. The first vibration system 22 includes diaphragm 221. Housing 10 includes a bottom wall 14 facing the diaphragm 221, and a sidewall 15 bent and extended at the outer edge of the bottom wall 14. Frame 21 includes a split body of the first frame 211 and the second frame 212. The second frame 212 extended toward the side wall 15 and is fixed to the sidewall 15.

Figure 2:
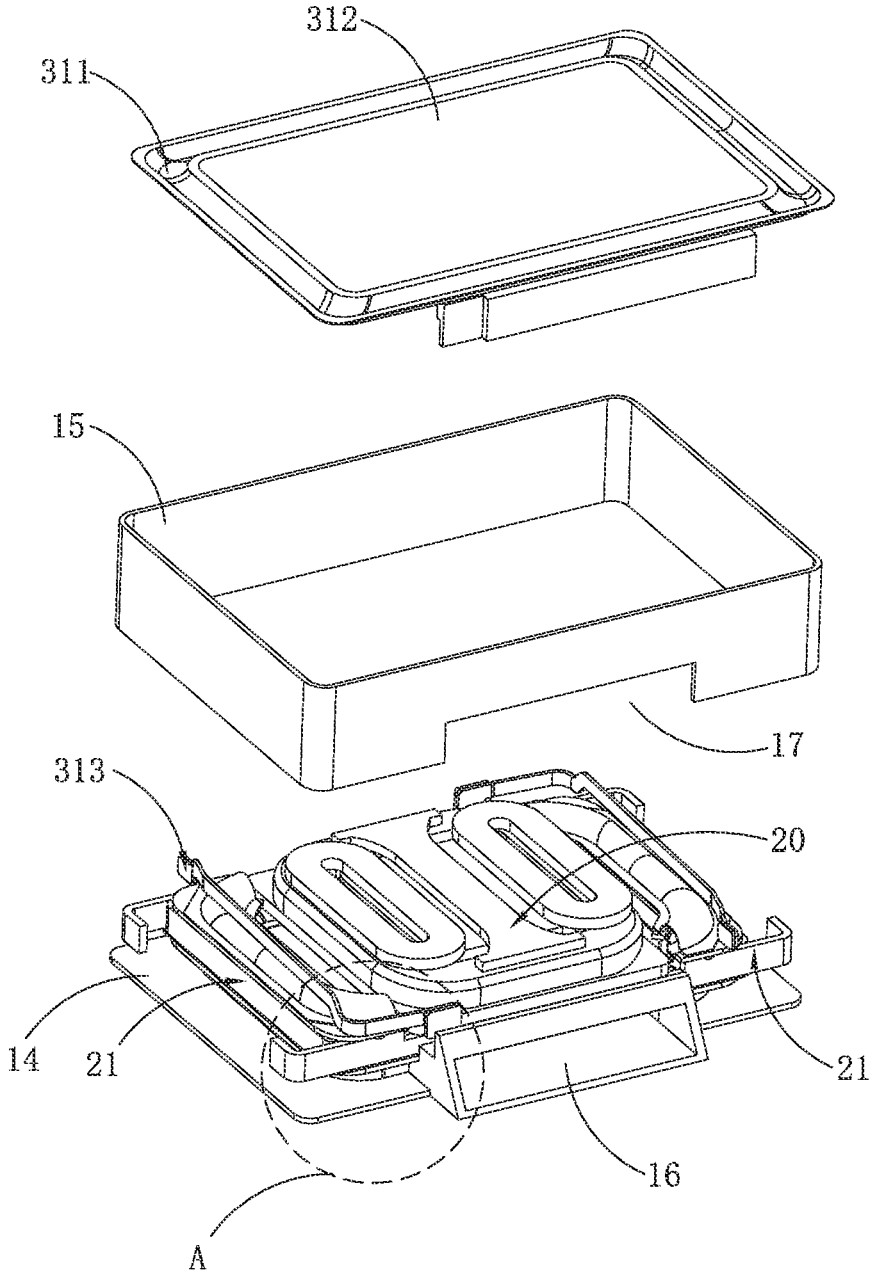
FIG. 2 is a exploded view of the speaker shown in FIG. 1.
Figure 3:
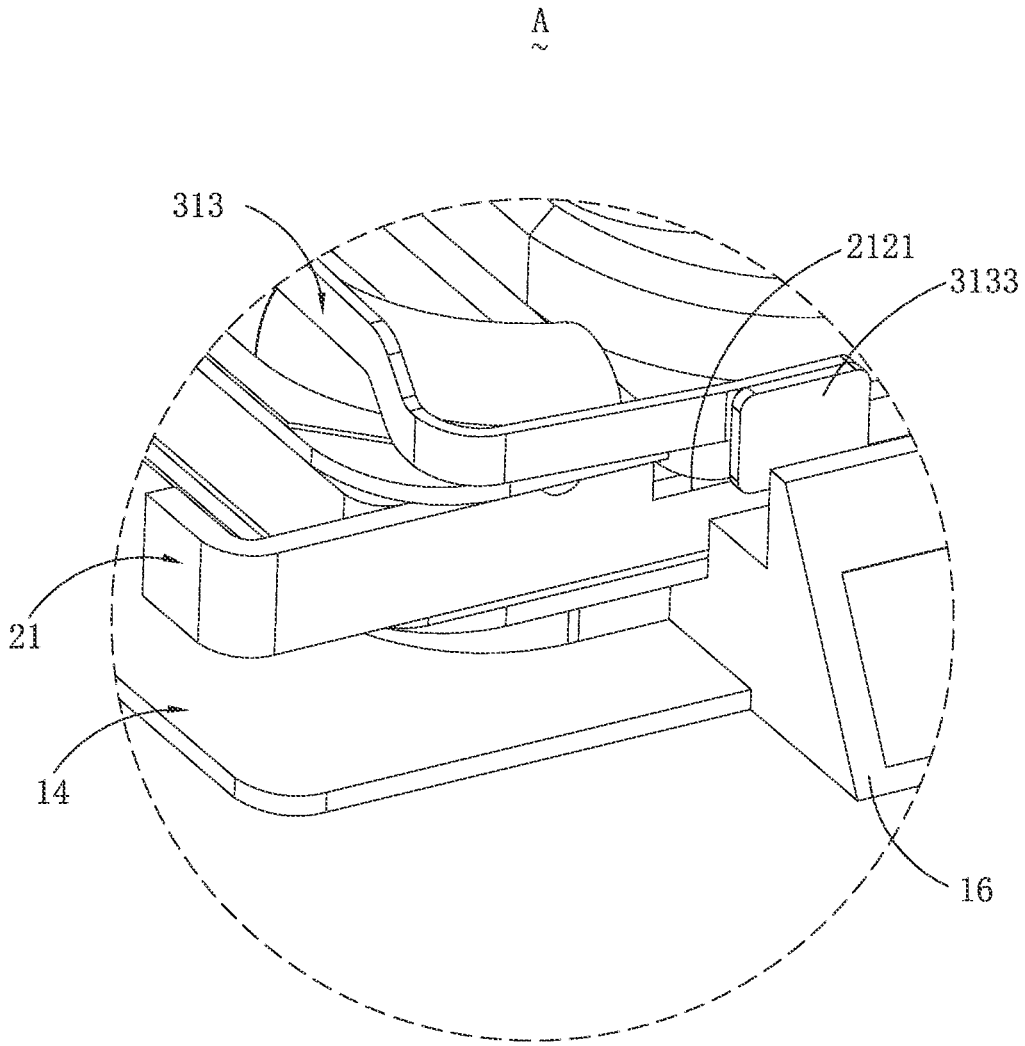
FIG. 3 is an enlarged view of the part A in the FIG. 2.

Referring to the FIG. 2, housing 10 includes a bottom housing 14 and a middle housing 15. The middle housing 15 and the bottom housing 14 are enclosed to form the accommodating space, and the speaker 20 is enclosed inside housing 10. One side of the bottom housing 14 protrudes outward to form a sounding hole 16, and the sounding hole 16 is used to diffuse the sound emitted by the speaker 20. Specifically, the middle housing 15 has a sleeve-shaped structure, and an opening 17 is provided on the middle 15 corresponding to the sounding hole 16. The opening 17 is adapted to the sounding hole 16 formed by the protrusion, and the bottom housing 14 has a central and side protrusions plated-shaped structure.

Figure 4:
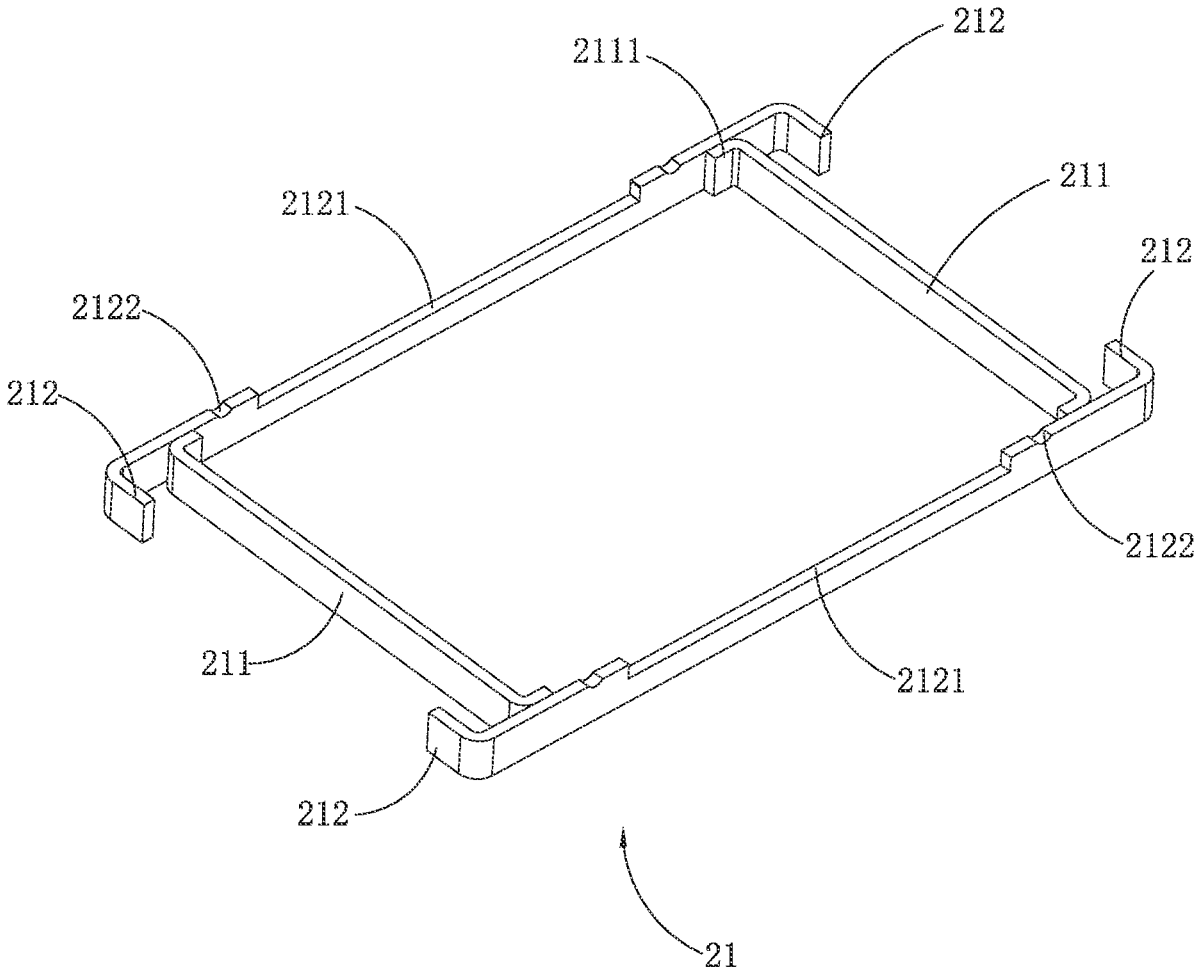
FIG. 4 is a three-dimensional view of the frame of the speaker box shown in FIG. 1.
Figure 5:
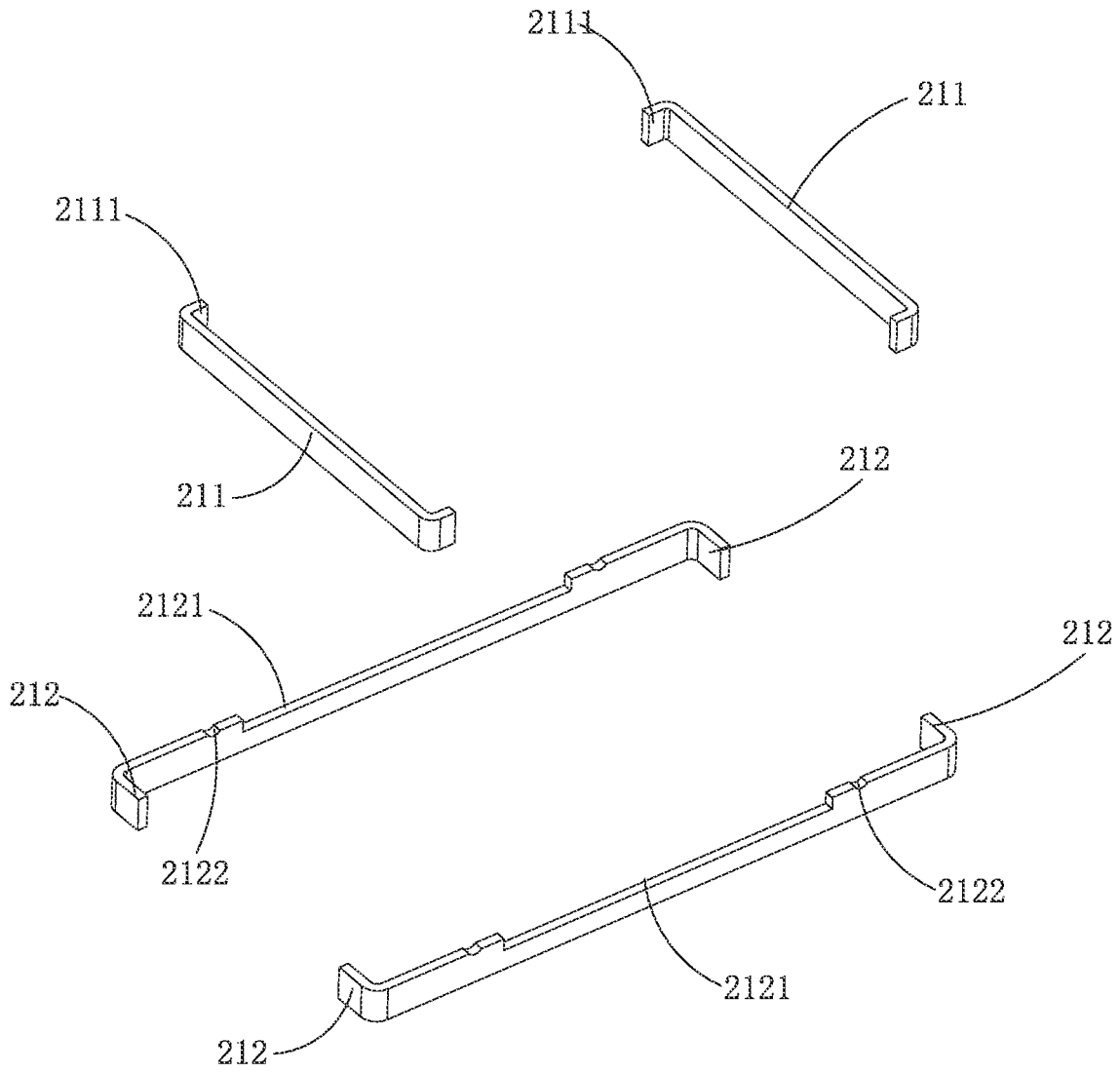
FIG. 5 is a exploded view of the frame shown in FIG. 4

Referring to FIGS. 4-5, both ends of the first frame 211 and the second frame 212 are provided with bending parts, and the bending parts on the first frame 211 are used for the first frame 211 and the second frame 211 to connect. The bent part on the second frame 212 is used to fix the first frame 211 and the second frame 212 to the housing 10. Specifically, both ends of the first frame 211 are bent inward to form the first connecting part 2111; the first connecting part 2111 is connected with the inner wall of the second frame 212 to form an integrated structure. The first connecting part 2111 and the second frame 212 are connected by welding to form an integrated structure. Compared with the static connection methods such as buckle and threaded connection, this embodiment adopts the welding method to connect, making the structure compact and the space occupied is small on the one hand. On the other hand, the first connecting part 2111 formed by bending makes the gap between the first frame 211 and the second frame 212 increase significantly. At the same time, the bending structure can also enhance the overall rigidity of the first frame 211 and the second frame 212, thereby providing good protection to the internal structure of the speaker box and ensuring the impact resistance and drop resistance of the speaker box.

Further, an avoiding groove 2121 is recessed inwardly in the middle section of the second frame 212 along the first direction. The speaker 20 is connected to the housing 10 through the avoiding groove 2121, making the speaker 20 and the avoiding groove 2121 more compact and reasonable. According to the different positions or connection positions of the speaker 20, the avoiding groove 2121 can also be provided on the first frame 211. Meanwhile, the avoiding groove 2121 can be placed on the first frame 211 and the second frame 212 simultaneously. The space occupied by the connection is smaller, and the overall volume is reduced. On the other hand, the connection through multiple points makes the connection structure between the speaker 20 and frame 21 more reliable. Furthermore, the second frame 212 is further provided with arc-shaped grooves 2122 at both ends of the avoiding groove 2121.

Furthermore, in some implementations, the magnetic assembly 231 of the speaker 20 is welded to the second frame 212. In some optional embodiments, the magnetic assembly 231 can also be welded and connected to the first frame 211 as required or can be welded and connected to the first frame 211 and the second frame 212 simultaneously.

The diaphragm 221 has a rectangular ring structure as a whole, and the diaphragm 221 includes a rectangular ring-shaped diaphragm fixing portion 2211 and a convex limiting portion 2212 formed on the side facing the frame 21. The fixing portion 2211 and frame 21 are connected to the side near the diaphragm 221. The limiting portion 2212 is connected to the first connecting portion 2111. Further, the limiting portion 2212 is an arc-shaped column of the self-diaphragm 221 extending in a direction close to frame 21, and the limiting portion 2212 is clamped on the first connecting portion 2111 or fixedly connected to the first connecting portion 2111. The connecting portion 2111 is thereby fixedly connected to the fixing portion 2211 of the diaphragm 221 and frame 21.

Further, in some optional embodiments, the diaphragm 221 and the frame 21 are integrally formed as a whole, making the manufacturing process more straightforward and the assembly more convenient.

Figure 6:
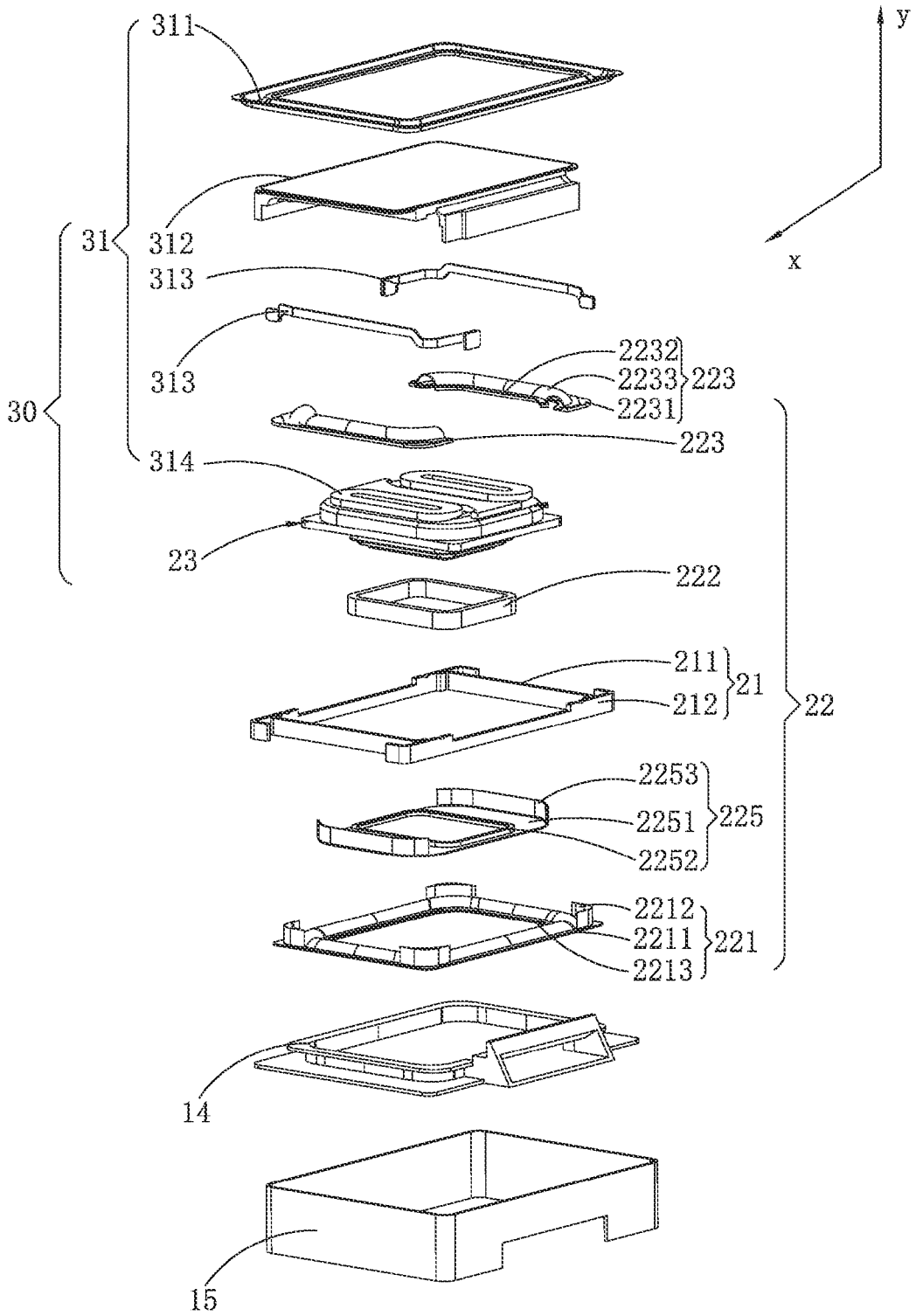
FIG. 6 is an exploded view of the speaker shown in FIG. 1.

The first vibration system 22 includes a diaphragm 221, a first coil 222 that drives the diaphragm 221 to vibrate and emit sound in a first direction, and a skeleton 225 that connects the first coil 222 and the diaphragm 221 And an elastic diaphragm assembly 223 that elastically supports the skeleton 225. The diaphragm 221 also includes a diaphragm vibration portion 2213 formed by bending along the inner side of the annular diaphragm fixing portion 2211. The diaphragm vibrating portion 2213 is connected to the first coil 222 provided on the magnetic assembly 231, and the vibration of the first coil 222 drives the diaphragm vibrating portion 2213 to vibrate. Referring to FIG. 6, the elastic diaphragm assembly 223 includes an arc-shaped elastic diaphragm assembly fixing portion 2231 and an elastic diaphragm assembly vibration portion 2232 formed by bending along the inner side of the arc-shaped elastic diaphragm assembly fixing portion 2231. Elastic diaphragm assembly fixing portion 2232 is fixed to frame 21, and the elastic diaphragm assembly vibrating part 2232 is connected to frame 225. Specifically, skeleton 225 has a hollow rectangular structure as a whole. It includes a skeleton body portion 2251 located in the middle portion, a first spacer 2252 extending from the inner side of the skeleton body portion 2251 in a first direction toward the first coil 222, and a second spacer 2253 extending from the skeleton body portion 2251. The second spacer 2253 is bent and extended towards the elastic diaphragm assembly 223. The first spacer 2252 passes through frame 21 and is fixed to the elastic diaphragm assembly 223. The mainframe body portion 2251 is fixedly connected to the first coil 222. The outer periphery of frame 225 is fixed to the diaphragm vibration portion 2213 in the middle of the diaphragm 221.

The magnetic circuit system 23 includes a first yoke 231, a second yoke 232, and a magnetic assembly 233 sandwiched between the first yoke 231 and the second yoke 232. The magnet assembly 233 includes a primary magnet 2331 and a secondary magnet 2332 arranged at intervals around the primary magnet 2331. The first coil 222 is arranged in the magnetic gap formed between the primary magnet 2331 and the secondary magnet 2332, and the first yoke 231 is connected to frame 21. The magnetic circuit system 23 drives the first coil 222 to drive the diaphragm 221 to vibrate along the first direction. The first direction is the direction indicated by the arrow y in FIG. 6, and in some optional embodiments, the first direction is the vertical direction.

The edges of the diaphragm 221 and the elastic diaphragm assembly 223 are fixedly connected to frame 21, and then fixed to the housing 10 through frame 21, and through the first spacer 2232 of the frame 225 and the second spacer 2233 to connect the diaphragm 221 and the elastic diaphragm assembly 223. The skeleton 225, in turn, connects the vibrating part 2213 of the diaphragm 221 with the first coil 222 in the magnetic circuit system 23, and then drives the first coil 222 to vibrate through the magnetic circuit system 23. Then the first coil 222 drives the skeleton 225 to vibrate. At the same time, the skeleton 225 drives the diaphragm 221 and the elastic diaphragm assembly 223 to vibrate in the same direction, finally realizing the sound of the speaker box.

The speaker box of this invention further includes a vibrator 30, and the vibrator 30 includes a second vibration system 31 and a magnetic circuit system 23. The second vibration system 31 includes a spacing diaphragm 311, a counterweight 312, an elastic member 313 and a second coil 314 arranged on both sides of the second yoke 232. The spacing diaphragm 311 includes a spacing diaphragm fixed portion 3111 and a spacing diaphragm vibrating portion 3112 formed by bending along the inner side of the spacing diaphragm fixing portion 3111. The spacing diaphragm fixing portion 3111 is connected to the end surface of housing 10. Then the spacing diaphragm vibrating portion 3112 is connected to the peripheral edge of one end of the counterweight 312, and one end of the elastic member 313 is connected to the counterweight 312. The other end is connected to the inner wall of housing 10. In this way, the counterweight is suspended in housing 10. The second coil 314 is connected to the counterweight 312 and is arranged opposite to the magnet assembly 233. The magnetic circuit system 23 drives the second coil 314 to drive the counterweight 312 to vibrate in the second direction. Then the second direction is perpendicular to the first direction, and the arrow x indicates the second direction in FIG. 6. However, in some implementations, the second direction is horizontal.

Figure 7:
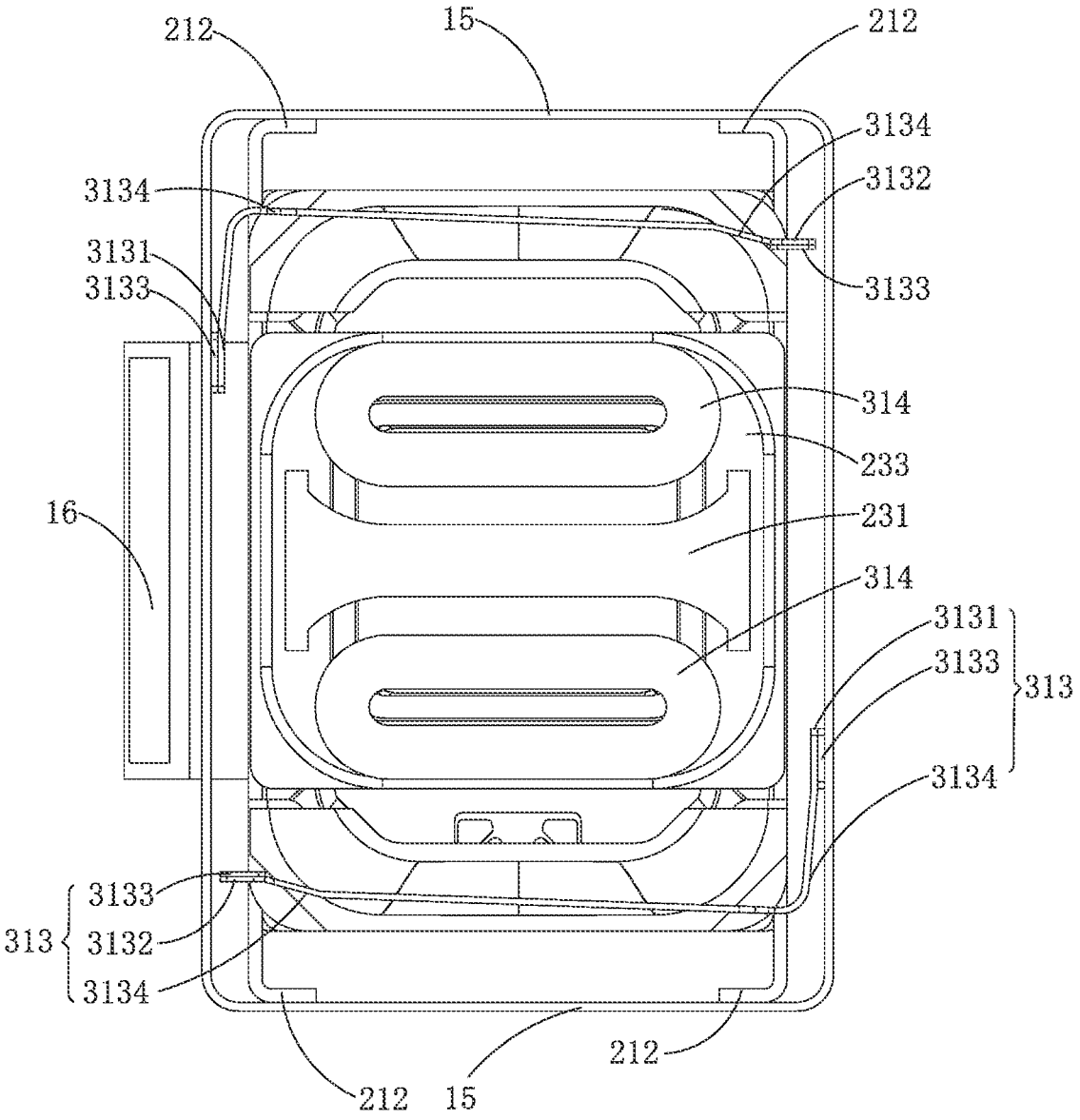
FIG. 7 is a top view of the speaker box with the spacing diaphragm removed shown in FIG. 1.
Figure 8:
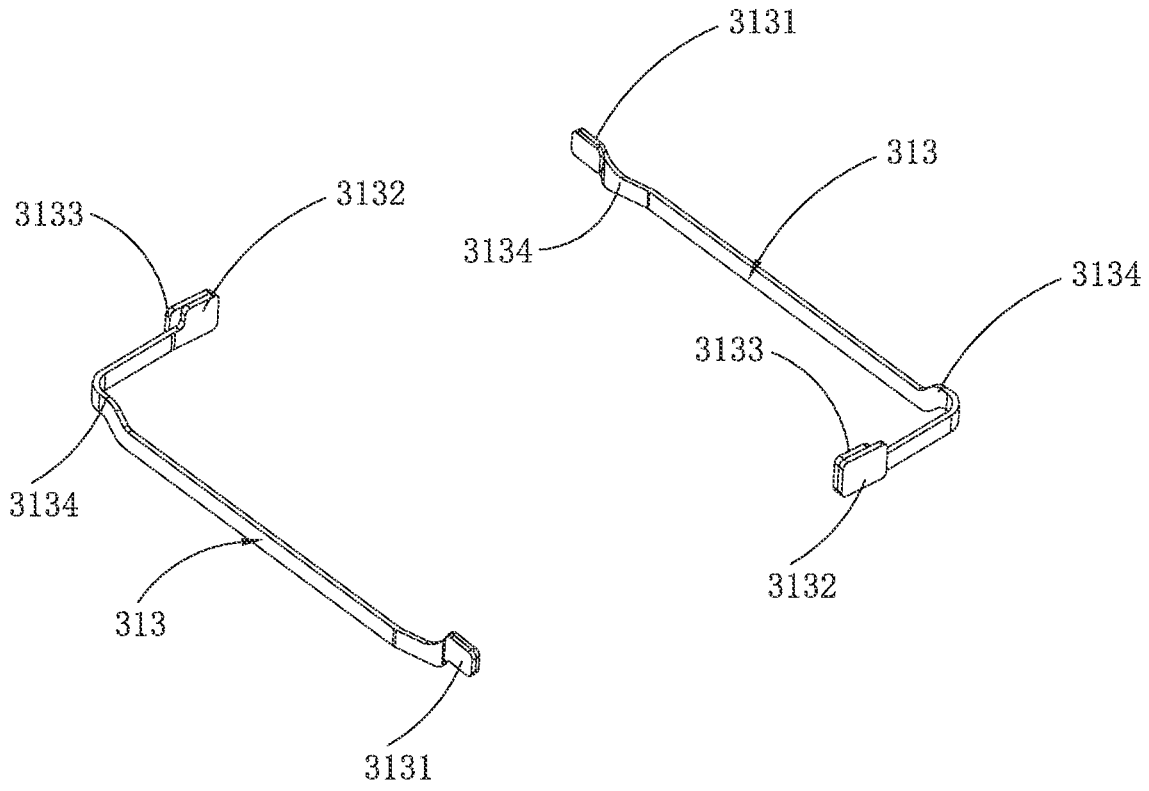
FIG. 8 is a three-dimensional view of the elastic member of the speaker box shown in FIG. 1.
Figure 9:
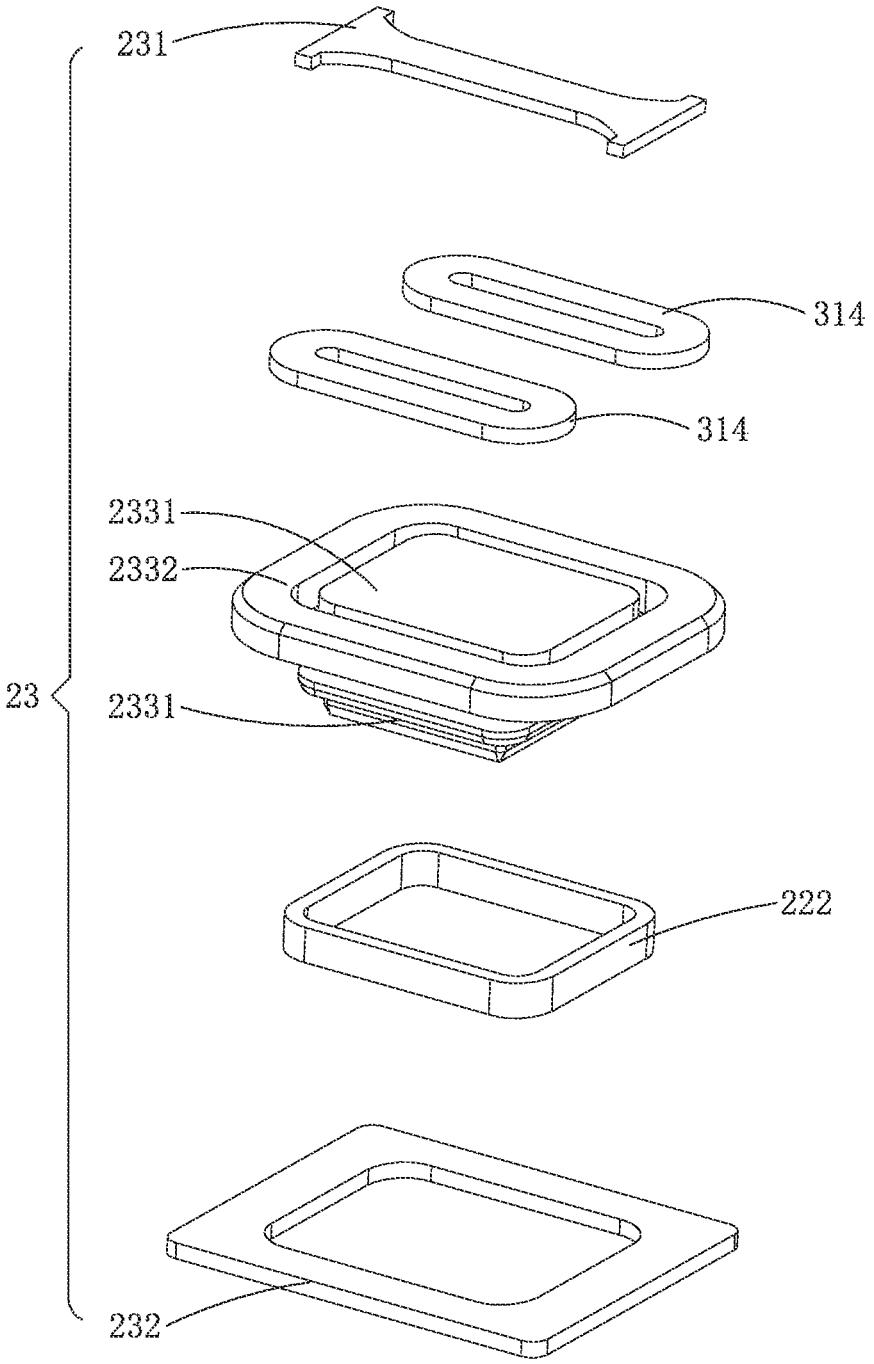
FIG. 9 is an exploded view of the speaker box shown in FIG. 1.

Furthermore, referring to FIGS. 7-8, the elastic member 313 has an L-shaped structure as a whole, and the elastic member 313 includes a second connecting portion 3131 and a third connecting portion 3132. The second connecting portion 3131, and the third connecting portion 3132 are also provided with a connecting plate 3133, one side of which is connected to the second connecting portion 3131, and the other side is connected to the inner wall of the housing 10 or the counterweight 312. Alternatively, one side of the connecting plate 3133 is connected to the third connecting portion 3132, and the other side is connected to the inner wall of housing 10 or the counterweight 312. In some implementation, the second connecting portion 3131 and the third connecting portion 3132 are arranged at an angle, and the two forms an elastic structure. Further, an undulating bending structure 3134 is provided at the angle between the second connecting portion 3131 and the third connecting portion 3132. The undulating bending structure 3134 is used to avoid the arched portion 2233 on the elastic diaphragm assembly 223, making the speaker box integrate the sound-emitting unit 20 and the vibrating unit 30 while keeping the internal structure compact. In addition, the sound generating unit 20 and the vibrating unit 30 share the magnetic circuit system 23 so that the speaker structure of the embodiment of the present invention is more compact and small.

It can be known from the above that when the speaker box includes the sound-producing unit 20 and the vibrating unit 30, the speaker box has at least two operating characteristics. The first coil 222 is connected to a high-frequency current in one working mode to drive the diaphragm 221 to vibrate and produce sound. The second coil 314 is connected to a low-frequency current to drive the counterweight to generate vibration feedback in another operating mode.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker box, comprising:

a speaker, comprises a frame, a first vibration system and a magnetic circuit system fixed on the frame; the first vibration system providing a diaphragm vibrate along a first direction;

a housing with an accommodation space, comprises:

a bottom wall facing the diaphragm, and a sidewall bending and extending from an outer edge of the bottom wall;

wherein the speaker received in the accommodation space, and the frame of the speaker comprises a split body of a first frame and a second frame, the second frame extends and fixed to the sidewall, and both ends of the first frame are bent inward to form a first connecting part, the second frame is connected to the first connecting part.

2. The speaker box as described in claim 1, wherein the first connecting part and the second frame are connected by welding.

3. The speaker box as described in claim 1, wherein a limiting portion formed on a side facing the frame of the diaphragm, the limiting portion is connected to the first connecting part.

4. The speaker box as described in claim 3, wherein the diaphragm and the frame are integrally formed as a whole.

5. The speaker box as described in claim 1, wherein an avoiding groove is recessed on the second frame along the first direction, and the speaker is connected to the housing through the avoiding groove.

6. The speaker box as described in claim 5, wherein the magnetic circuit system is welded to the avoiding groove.

7. The speaker box as described in claim 1, wherein the first vibration system further comprises: a first coil driving the diaphragm to vibrate along the first direction; a skeleton connecting the first coil and the diaphragm, and an elastic diaphragm assembly elastically supporting the skeleton, the skeleton comprises an skeleton body portion, a first spacer extending from an inner side of the skeleton body portion towards the first coil along the first direction, and a second spacer extending from an outer side of the skeleton body portion towards the elastic diaphragm assembly along the first direction; the elastic diaphragm assembly comprises an elastic diaphragm assembly fixing portion fixed to the frame and an elastic diaphragm assembly vibration portion fixed to the first spacer.

8. The speaker box as described in claim 7, wherein further comprises a second vibration system vibrate along a second direction perpendicular to the first direction; the second vibration system comprises a spacing diaphragm, a counterweight, an elastic member and a second coil fixed to the counterweight, the spacing diaphragm comprises a spacing diaphragm fixed portion and a spacing diaphragm vibrating portion formed by bending along the a side of the spacing diaphragm fixing portion; the spacing diaphragm fixing portion is connected to the housing while the spacing diaphragm vibrating portion is connected to the counterweight, and an end of the elastic member is connected to the counterweight while the other end is connected to the housing, the second coil is spaced from the magnetic circuit system along the first direction.

9. The speaker box as described in claim 8, wherein the elastic member comprises a second connecting portion and a third connecting portion, an undulating bending structure is providing at an angle between the second connecting portion and the third connecting portion.

* * * * *